United States Patent [19]

Mamach

[11] Patent Number: 4,490,941

[45] Date of Patent: Jan. 1, 1985

[54] SPINDLE DOOR OPERATOR

[75] Inventor: Harry E. Mamach, Schaumburg, Ill.

[73] Assignee: Vapor Corporation, Chicago, Ill.

[21] Appl. No.: 292,359

[22] Filed: Aug. 13, 1981

[51] Int. Cl.[3] ..... E05F 15/10

[52] U.S. Cl. ..... 49/28; 49/110; 49/334; 49/337

[58] Field of Search ..... 49/26, 28, 110, 111, 49/334, 338, 327

[56] References Cited

U.S. PATENT DOCUMENTS 4,055,023 10/1977 Gatland et al. ..... 49/28

4,308,691 1/1982 Horn ..... 49/334 X

*Primary Examiner*—Kenneth Downey

*Attorney, Agent, or Firm*—Francis J. Lidd

[57] ABSTRACT

A door operator for opening and closing doors on transit vehicles and the like includes an actuator (50) secured to the transit vehicle (10). The actuator houses a worm drive and a reciprocating air cylinder (52) for imparting rectilinear motion to the worm drive. A door shaft (18) is coupled to a door (14) and mechanically coupled to the worm drive such that rectilinear motion of the system is transmitted by the worm drive into rotary motion to the drive shaft to open and close the door. A cam (90) is secured to the vehicle and adjacent to a cam follower (108) that is secured to the door shaft. The cam follower engages the cam during approximately the initial 80% motion during closing of the door and approximately the final 80% of the door opening. A recycling switch (200) for the door may be mounted in the vehicle adjacent to the cam in a position to be engaged upon engagement of the door with an object to recycle the door.

4 Claims, 6 Drawing Figures

FIG. 1
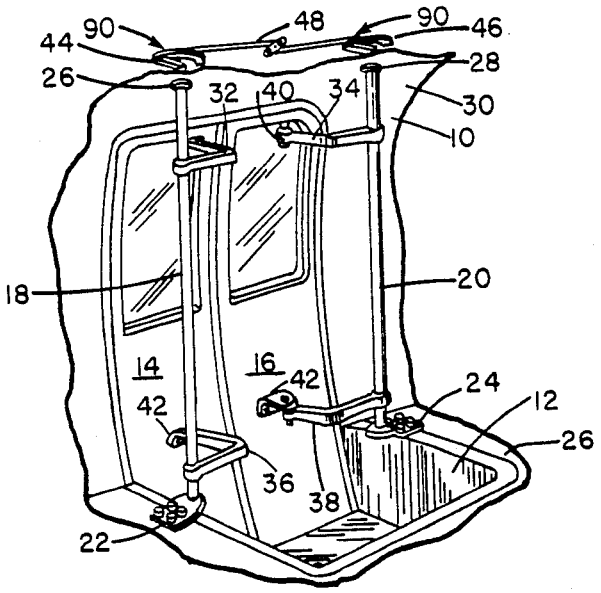
FIG. 2
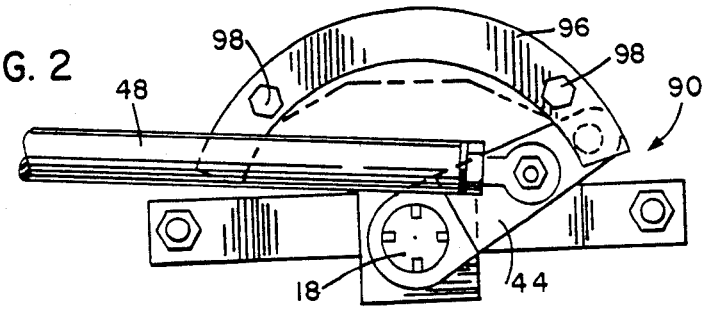
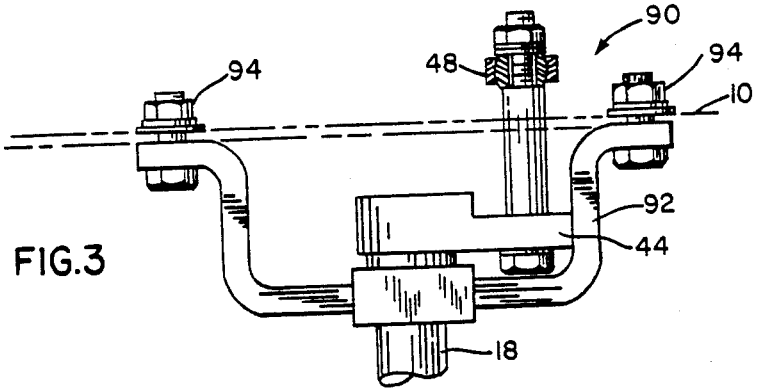
FIG.3

SPINDLE DOOR OPERATOR

BACKGROUND OF THE INVENTION

The present invention relates to a new and improved door operator for opening and closing doors on transit vehicles and the like.

In the prior art, doors on transit vehicles and the like are opened by rotating a door shaft that is connected to the door. The door shaft is rotated by an actuator that includes a piston reciprocally mounted therein, the rectilinear motion of which is translated into rotary motion to the door shaft by a helical or worm drive in the actuator. A description of such prior art device is presented in French Pat. No. 7,044,248.

A characteristic of this prior art system is that upon complete door closure, the rotating door shaft will impart a lifting movement to the doors. Lift or upward movement occurs, since further rotary motion of the door shaft is not possible and rotary motion is translated to rectilinear motion. This lifting in the door closed position is utilized to actuate locking elements that are mounted on the door frame and the door that engage each other upon door closing thereby locking and preventing further door lift. Such a door locking device is disclosed in German Pat. No. 2,805,639.

A problem exists in the prior art of lifting of the door upon engagement of the door during the closing or opening operation with an object such as a person or the like. In this particular situation, if the door engages an object, the rotary motion of the door shaft is translated into rectilinear motion causing lifting of the door. If the obstruction has been removed the door will continue to close in this lifted or non-aligned position resulting in misalignment of the door/frame in the fully closed position. It is therefore desirable to overcome this problem to ensure proper closure of the door and also to provide recycling of the door upon engagement with an object.

SUMMARY OF THE INVENTION

An object of the present invention is to provide a new and improved door operator for doors on transit vehicles and the like.

A further object of the present invention is to provide a new and improved door operating system for doors on transit vehicles and the like that will prevent closure of a door in a non-aligned position.

A still further object of the present invention is to provide a new and improved operating door operating system on transit vehicles that will recycle the door upon engagement with an object such as a person or the like.

Briefly, the present invention is directed to a new and improved door operator for opening and closing doors on transit vehicles and the like. The door operator includes an actuator secured to the transit vehicle with an air cylinder mounted for rectilinear motion in the actuator. The air cylinder is coupled to a worm gear. A door shaft is coupled to the worm gear such that rectilinear motion of the air cylinder is translated by the worm gear to rotary motion to the door shaft. The door shaft is also connected to a door of the transit vehicle such that rotary motion of the door shaft results in opening and closing of the door. A cam is secured to the vehicle and engages a cam follower secured to the door shaft. The cam follower is in engagement with the door shaft during approximately the last 80% of the door opening motion and approximately the first 80% of the door closing motion such that if the door engages an object, the door cannot lift and later close in a non-aligned position.

In an alternative embodiment of the present invention a switch is located adjacent to the cam and cam follower and when actuated, recycles the door upon engagement with an object.

BRIEF DESCRIPTION OF THE DRAWINGS

The above and other objects and advantages and novel features of the present invention will become apparent from the following detailed description of the preferred embodiment of the invention illustrated in the accompanying drawing wherein:

FIG. 1 is a view of a door of a transit vehicle with a door operator constructed in accordance with the principles of the present invention;

FIG. 2 is a plan view of the upper end of the door operator with a cam constructed in accordance with the principles of the present invention;

FIG. 3 is a vertical view of the upper end of the door operator;

DESCRIPTION OF THE PREFERRED EMBODIMENT

Figure 4:
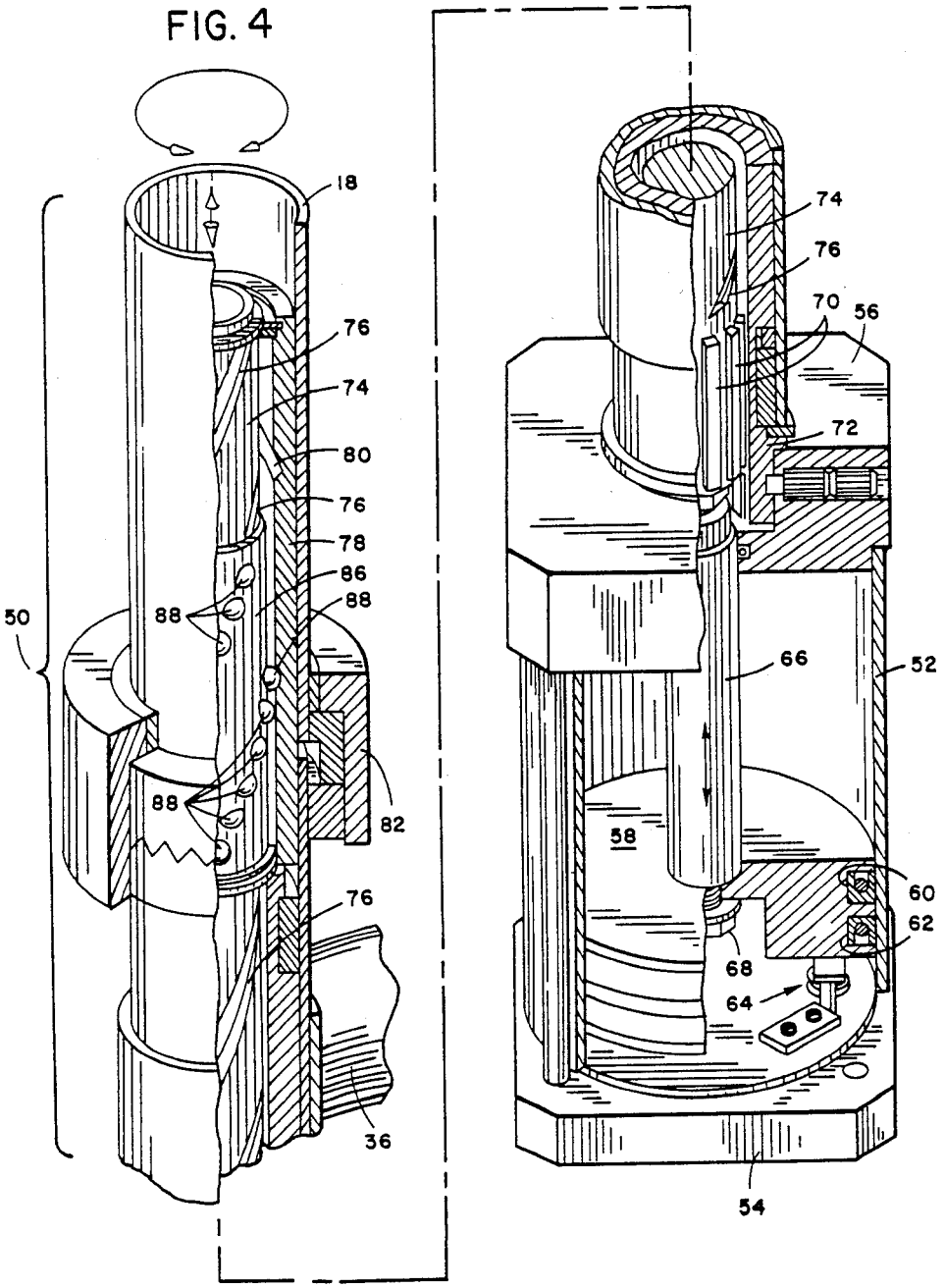
FIG. 4 is a partially cut away view of the actuator and door shaft constructed in accordance with the principles of the present invention.

Referring now to the drawings and initially to FIG. 1 there is illustrated a portion of a transit vehicle 10 with a step or stairwell 12 leading to a pair of door panels 14 and 16. The doors 14 and 16 are opened by first 18 and second 20 door shafts that are rotated in first 22 and second 24 lower shaft support bracket assemblies that are secured to the floor 26 of the transit vehicle 10. The door shafts 18 and 20 extend through bearings 26 and 28, respectively, that are mounted within the ceiling 30 of the transit vehicle 10. The door shafts 18 and 20 are secured to the door panels 14 and 16 by upper boomerang, drive or control arms 32 and 34 and lower boomerang, drive or control arms 36 and 38. The upper drive arms 32 and 34 are connected to the door panels 14 and 16 by upper door panel bracket assemblies 40 and the lower drive arm 36 and 38 are secured to the door panels by lower door panel bracket assemblies 42.

The upper ends of the door shafts 18 and 20 are connected to levers 44 and 46, respectively, that are in turn connected to a teetering linkage generally designated by the reference numeral 48. The teetering linkage 48 functions to coordinate the movement of the door shafts 18 and 20 and to ensure that the doors 14 and 16 are maintained in lined up position while they are in the closed position.

The door shafts 18 and 20 are rotated by actuators positioned beneath the floor 26 adjacent the step or stairwell 12. One actuator is illustrated in FIG. 4 and generally designated by the reference numeral 50. The actuator 50 includes a housing or cylinder 52 mounted rigidly upon a cylinder end cap 54 and capped at the upper end by an upper cap 56. Mounted within the cylinder 52 is a piston 58 that is reciprocated within the cylinder 52 by air pressure. Seals 60 and 62 are positioned within outer peripheral surface of the piston 58 to prevent leakage. A cushioning device generally designated by the reference numeral 64 is below the piston 58 and secured to the cylinder end cap 54. Similarly, identical elements (not shown) on the opposite end of the cylinder effect cushioning on door opening. The cushioning pin device 64 is a air choking device that controls the flow of air out of the cylinder 52 beneath the piston 58 upon downward movement of the piston 58 within the cylinder 52. This choking of exhaust air by the cushioning device 64 provides a cushion to the downward movement of the piston 58 resulting in a smooth closing of the door panels 14 and 16.

A vertical drive shaft 66 is secured to the piston 58 by a fastener 68 and is reciprocated thereby. The vertical drive shaft 66 includes splines 70 that are aligned within a splined hub 72 thereby preventing rotation of the vertical drive shaft 66 allowing only rectilinear motion. At the upper end of the drive shaft 66 is a vertical drive shaft ball race 74 including individual helical raceways 76. A rotary drive shaft 78 is mounted above the hub 72 and includes rotary drive shaft ball raceways 80 fabricated on the inner peripheral surface thereof. The rotary drive shaft 78 is coupled by a drive shaft coupling 82 to the drive shaft 18.

A ball cage 86 is mounted around the outer peripheral surface of the vertical drive shaft ball raceway 26 and within the inner peripheral surface of the rotary drive shaft 78. The ball cage 86 includes a plurality of individual bearings or balls 88 that are aligned corresponding to the path of the raceways 76 and 80.

As will be understood by those ordinarily skilled in the art, upon rectilinear or reciprocating motion of the vertical drive shaft 66, this motion, through the innerraction of the ball cage 86 balls 88, and the raceways 76 and 80, is translated into rotary motion of the door shaft 18. This rotation is imparted through the boomerang or drive arm 36, for example, to open or close the door panel 14. It should be understood that each door shaft 18 and 20 includes an actuator 50 to rotate it.

Figure 6:
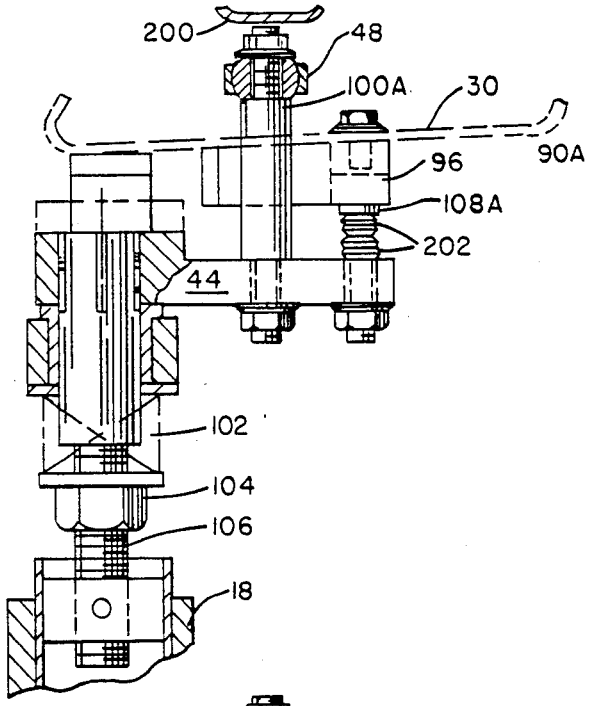
FIG. 6 is a view similar to FIG. 5 of an alternative embodiment with a recycling switch.
Figure 5:
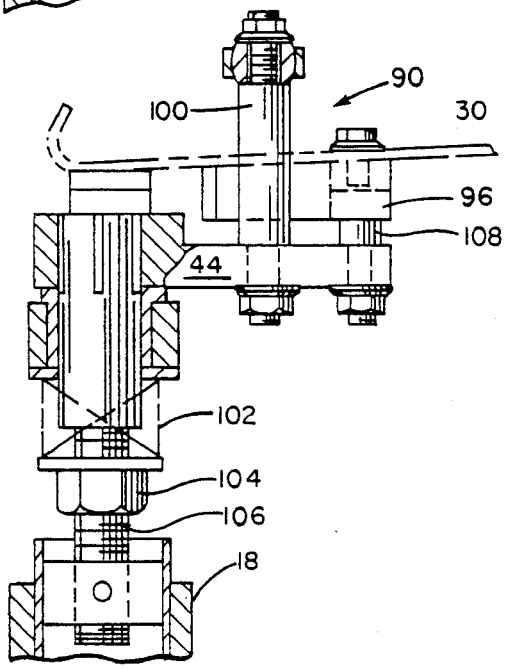
FIG. 5 is a a vertical partially sectioned view of the upper end of the door operator and cam.

During opening or closing of the door panel 14 and 16 if an object is engaged, the rotary motion of the door shafts 18 and 20 are translated into rectilinear motion resulting in lifting of the door panels 14 and 16. Thereafter, if the obstruction is removed and the door panels 14 and 16 are closed, they will close in a non-aligned position resulting in an undesirable situation. In accordance with the principles of the present invention, the rectilinear motion of the door shafts 18 and 20 and the lifting of the panel doors 14 and 16 is prevented through the employment of cam assemblies generally designated in FIG. 1 by the reference numerals 90. Each cam assembly 90 includes a bracket 92 (FIG. 3) securing the assembly 90 to the transit vehicle 10 by fasteners 94. Each bracket 92 secures the upper end of each door shaft 18 and 20 to the transit vehicle 10. An arcuate cam 96 is also secured to the transit vehicle 10 by fasteners 98 (FIG. 2). Since all of the structure of the assemblies is identical, only the structure associated with the door shaft 18 will be explained. The lever 44 is secured to the teetering linkage by post rod 100 and is also connected to the door shaft 18 through a compression spring 102 by a hex nut 104 to a shaft stub 106 that is rigidly secured to the door shaft 18 (FIGS. 5 and 6). The lever 44 includes a cam pin or cam follower 108 that engages the cam 96 through approximately the first 80% of the door closing motion of the door panel 14 and the last 80% of the door opening motion of the door panel 14. The cam pin or cam follower 108 does not engage the cam 96 during approximately the first 20% of the door opening motion and approximately the last 20% of the door closing motion since during this portion of the opening and closing a sufficient amount of the door panel 14 is within the door frame defined in the bus 10 such that if the door panel 14 engages an object it will not rise or lift due to the constraint of the door frame. It should be understood that upon engagement of either door panel 14 and 16 with an object, a timing device operated by a conventional force sensitive edge is employed to terminate closing of the door panels 14 and 16 for a brief time to allow removal of the object from the path of the door. Typical application of a sensitive edge to vehicular doors is shown in U.S. Pat. No. 4,133,365, hereby incorporated by reference. Thereafter the door panels 14 and 16 continue the closing motion.

In an alternative embodiment illustrated in FIG. 6 a recycling switch 200 may be employed to recycle the door panels 14 and 16 upon engagement with an object. In the embodiment illustrated in FIG. 6, the same reference numerals are employed for the same structures previously described in FIGS. 1–5; different structures are indicated by the suffix A. Cam assembly 90A of the alternative embodiment is similar to the previous embodiment discussed except that the post rod 100A is mounted to slide or reciprocate relative to the cam 96 and the ceiling 30 of the transit vehicle 10. In addition, bellville washers 202 are positioned between the cam follower 108A and lever 44. Consequently, upon engagement of one of the door panels 14 and 16 with an object, the rotary motion from the actuator 50 is imparted as rectilinear motion to the door shafts 18 and 20 resulting in a lifting action being imparted through the lever 44 to the door panels 14 and 16. This upward movement of the lever 44 overcomes and compresses the bellville washers 202 resulting in engagement of the upper end of the post rod 100A with the switch 200 thereby actuating the switch and recycling the door.

What is claimed and sought to be covered by U.S. Letters Patent is:

1. A door operator for opening a door of transit vehicles and the like, comprising:

an actuator, a worm drive in said actuator, a piston reciprocally mounted in said actuator and coupled to said worm drive, a door shaft coupled to a door mounted on a vehicle, said door shaft mechanically coupled to said worm drive wherein rectilinear motion of said piston is transmitted as rotary motion to said door shaft to open and close said door, a cam assembly on said vehicle, including a cam, a cam follower coupled to said door and engaging said cam during approximately the last 80% of travel of said door during opening of said door and approximately the initial 80% of travel of said door during closing of said door.

2. The door operator claimed in claim 1 further comprising cushioning means for cushioning the motion of said piston at end positions of said door.

3. The door operator claimed in claim 1 further comprising a switch for recycling said door upon engagement of said door with an object, said switch mounted on said vehicle adjacent said cam assembly, and means biasing said cam assembly out of engagement with said switch.

4. A door operator for opening and closing doors on transit vehicles and the like, comprising:

an actuator mounted in a vehicle adjacent to a door on said vehicle to be opened by said actuator, said actuator includes a worm drive, a piston reciprocally mounted in said actuator and coupled to said worm drive to impart rectilinear motion to said worm drive, a door shaft coupled to said door and to said worm drive wherein said worm drive translates the rectilinear motion from said piston to rotary motion to said door shaft, a cam assembly including an arcuate cam mounted on said vehicle, a cam follower movably secured to said door engaging said cam during approximately the first 80% of the closing motion of said door and approximately the last 80% of travel during opening of said door, a switch for recycling said door upon engagement with an object mounted in said vehicle in a position to be actuated by said cam assembly, and means for biasing said cam assembly out of engagement with said switch.

* * * * *